US008225421B1

(12) United States Patent
Froissard

(10) Patent No.: US 8,225,421 B1
(45) Date of Patent: Jul. 24, 2012

(54) FACE SHIELD

(75) Inventor: Laurent Froissard, Cranston, RI (US)

(73) Assignee: Sperian Eye & Face Protection, Inc., Smithfield, RI (US)

( * ) Notice: Subject to any disclaimer, the term of this patent is extended or adjusted under 35 U.S.C. 154(b) by 864 days.

(21) Appl. No.: 11/786,381

(22) Filed: Apr. 10, 2007

Related U.S. Application Data

(60) Provisional application No. 60/797,270, filed on May 3, 2006.

(51) Int. Cl.
*A42B 1/00* (2006.01)
*A42B 1/06* (2006.01)
*A42B 1/08* (2006.01)

(52) U.S. Cl. ..... 2/9; 2/410; 2/424

(58) Field of Classification Search ..... 2/410, 4, 2/5, 6.1, 6.2, 6.3, 6.4, 6.5, 6.6, 6.7, 6.8, 8.2, 2/15, 427, 424, 426, 10, 436, 437, 422; 128/201.15, 128/201.24, 201.25, 201.23; D29/106, 107, D29/108, 110, 112, 122
See application file for complete search history.

(56) References Cited

U.S. PATENT DOCUMENTS 3,259,908 A * 7/1966 Simpson et al. ..... 2/9
4,101,980 A 7/1978 Stepan et al.
4,462,119 A * 7/1984 Rudd ..... 2/424
4,507,809 A 4/1985 Stepan
4,707,863 A * 11/1987 McNeal ..... 2/436
6,102,033 A * 8/2000 Baribeau et al. ..... 128/201.24
6,149,268 A * 11/2000 Hall et al. ..... 351/62
6,578,572 B2 * 6/2003 Tischer et al. ..... 128/201.25
D503,498 S 3/2005 Canavan et al.
D503,499 S 3/2005 Howard et al.
D504,194 S 4/2005 Canavan et al.
D504,195 S 4/2005 Canavan et al.
D511,226 S 11/2005 Howard et al.
D511,227 S 11/2005 Canavan et al.
D511,865 S 11/2005 Canavan et al.
D512,187 S * 11/2005 Canavan et al. ..... D29/122
7,007,306 B2 3/2006 Howard et al.
2005/0091732 A1 * 5/2005 Howard et al. ..... 2/424

* cited by examiner

*Primary Examiner* — Khoa Huynh
*Assistant Examiner* — Jane Yoon
(74) *Attorney, Agent, or Firm* — Salter & Michaelson

(57) ABSTRACT

A face shield assembly that includes a protective element including an edge and a frame including a top portion, a bottom portion and a side portion, the frame further including: a) an opening sized to fit the protective element, the opening defined by an upper inner edge, a lower inner edge, and side inner edges of the frame; b) a lip spaced from the upper, lower and side inner edges so as to form a channel constructed and arrange to receive a portion of the edge of the protective element. The shield further includes an upper detent supported from the frame; a lower detent supported from the frame; an upper interlock disposed behind the upper detent and including at least one through passage in the protective element adjacent a top edge thereof, and at least one forwardly directed pin that engages with the passage; and a lower interlock disposed behind the lower detent and including at least one through passage in the protective element adjacent a bottom edge thereof, and at least one forwardly directed pin that engages with the passage.

32 Claims, 7 Drawing Sheets

FACE SHIELD

RELATED APPLICATION

Priority for this application is hereby claimed under 35 U.S.C. §119(e) to commonly owned and co-pending U.S. Provisional Patent Application No. 60/797,270 which was filed on May 3, 2006 and which is incorporated by reference herein in its entirety.

TECHNICAL FIELD

The present invention relates in general to a face shield assembly and pertains, more particularly, to an improvement in the support of the protective element or lens of the face shield assembly.

BACKGROUND DISCUSSION

The use of face shields to protect a user's eyes and face from various occupational hazards is well known in the prior art. Face shields are used in numerous professions as protective equipment including, for example, in the chemical, medical, construction and manufacturing fields. The face shield is typically supported on a user head by a support structure such as a headband, visor or helmet. The face shield is supported so that it is positioned in front of the user face during its use. It is typical for the lens of the face shield to come into contact with various types of debris, which can damage the lens, particularly over a long period of time. Thus, it is also advantageous if the lens can be readily replaced. It is also advantageous if the lens can be replaced without the requirement of fasteners for securing the lens or other protective element to the face shield frame.

A face shield assembly is disclosed in U.S. Pat. No. 7,007,306 in which I am a co-inventor and which is assigned in common with the present application. U.S. Pat. No. 7,007,306 is hereby incorporated by reference herein in its entirety. The face shield assembly employed in this patent uses a protective lens that is not fastened by means of any fasteners but that is instead removably secured within a frame of the assembly in a groove or channel. This arrangement makes it convenient to readily replace the lens or protective element if need be. However, it has been found that, even with the use of detents to capture the lens, the lens can dislodge from its frame, particularly if the face shield assembly is impacted, such as by being dropped.

Accordingly, it is an object of the present invention to provide an improved face shield assembly, particularly one in which the protective element or lens of the face shield assembly is more positively engaged and thus more positively secured within or to the face shield assembly frame. This object is attained preferably without the use of any fasteners and thus even though the lens or protective element is more securely retained it still can be readily removed for cleaning or replacement.

BRIEF SUMMARY OF THE INVENTION

In accordance with the present invention there is provided, for a face shield assembly, a protective element in combination with a support frame for holding the protective element. The protective element has a peripheral edge region that is adapted to engage about an opening in the support frame. Substantially opposed retaining areas of the peripheral edge region have interlocking members including, respectively, a protective element interlock member and a support frame interlock member. The interlock members are adapted for releasable interlocking engagement to hold the protective element in place in the support frame. These interlock members are also adapted to enable ready release of the protective element from the support frame.

In accordance with other aspects of the present invention, the interlocking members may include, for example, a slot or hole in the protective element and a pin, post or projection on the support frame that engages therewith. The opposed retaining areas may be disposed at the top and bottom of the support frame.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION

Figure 1:
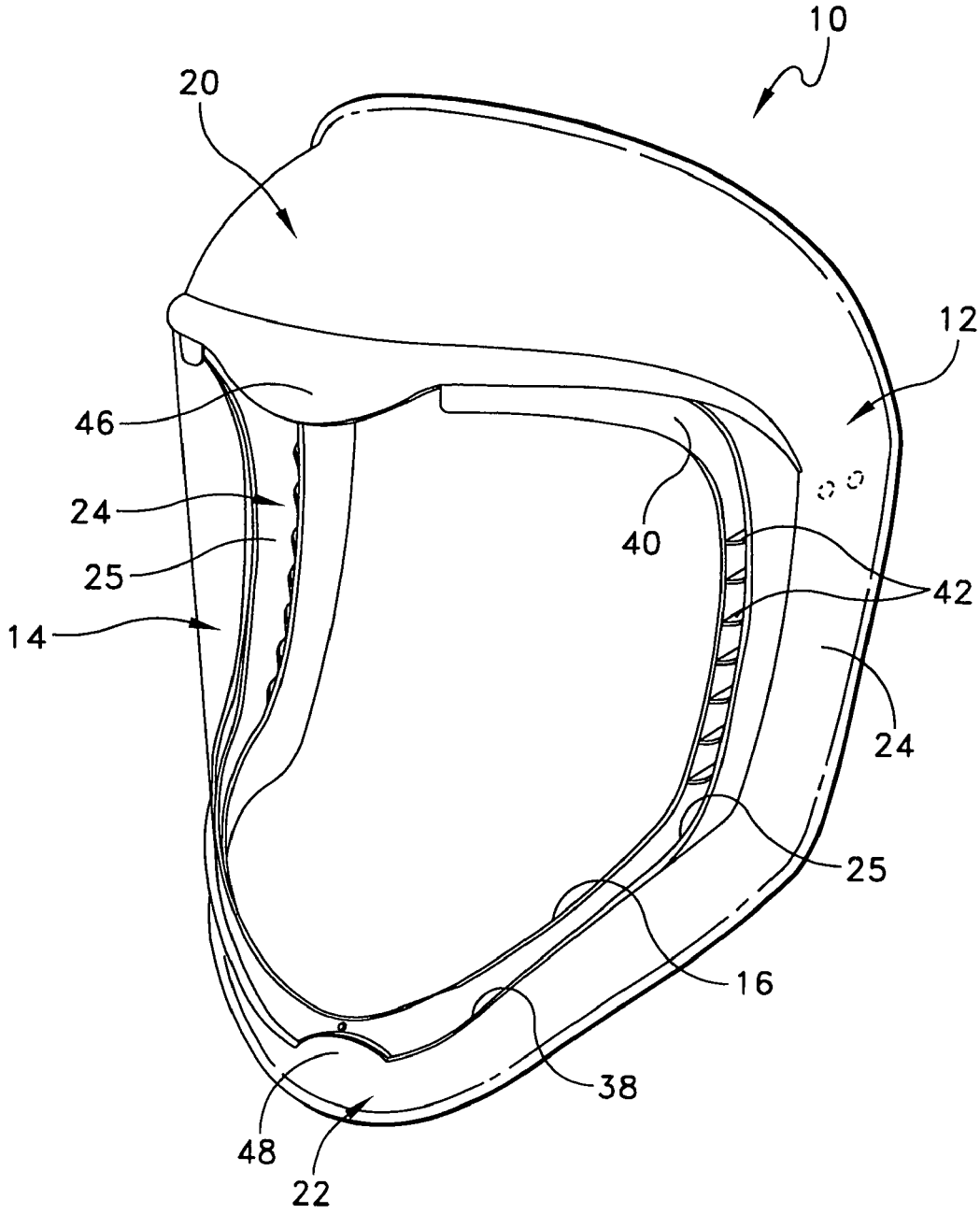
FIG. 1 is a front perspective view of a face shield assembly in accordance with the present invention including a protective element or lens supported within a support frame.

A face shield assembly for protecting a user's eyes and face is illustrated in FIGS. 1-9. The face shield assembly 10 includes a frame 12 and a protective element 14 that is removably supported in an opening 16 of the frame. The assembly may also include a head worn support structure (not shown) for supporting the frame in different positions including separate upper and lower positions. FIG. 22 of the aforementioned U.S. Pat. No. 7,007,306 illustrates the face shield assembly in relationship to the user's head.

The frame 12 preferably includes a top portion 20, a bottom portion 22, and side portions 24. In use, the top portion rests adjacent the forehead and top of the head of a user, while the bottom portion lies adjacent the jaw of the user, and the side portions are disposed adjacent the ears of the user. The top, bottom and side portions are preferably fabricated as a single, unitary member out of a lightweight material, for example polycarbonate or nylon although other lightweight materials may be utilized, as would be known to those of skill in the art. An opening 16 is bounded by an inner edge 25 of the top, bottom and side portions, respectively. The opening 16 is sized to receive the protective element 14 and preferably extends from a centerline of the face shield toward the edges of the face shield, so that the frame 12 does not obstruct the peripheral vision of the user.

The protective element 14 may be a lens made of a substantially transparent material, may be a mesh having very fine openings, or may be made of any other suitable material known in the art. The protective element 14 is preferably formed as a single, unitary member having a shape defined by an outer peripheral edge 28 (FIG. 2), which is preferably continuous. Because the protective element 14 is supported within the frame 12 without the use of fasteners, there is no need for any openings for receiving fasteners in the protective element 14.

Figure 2:
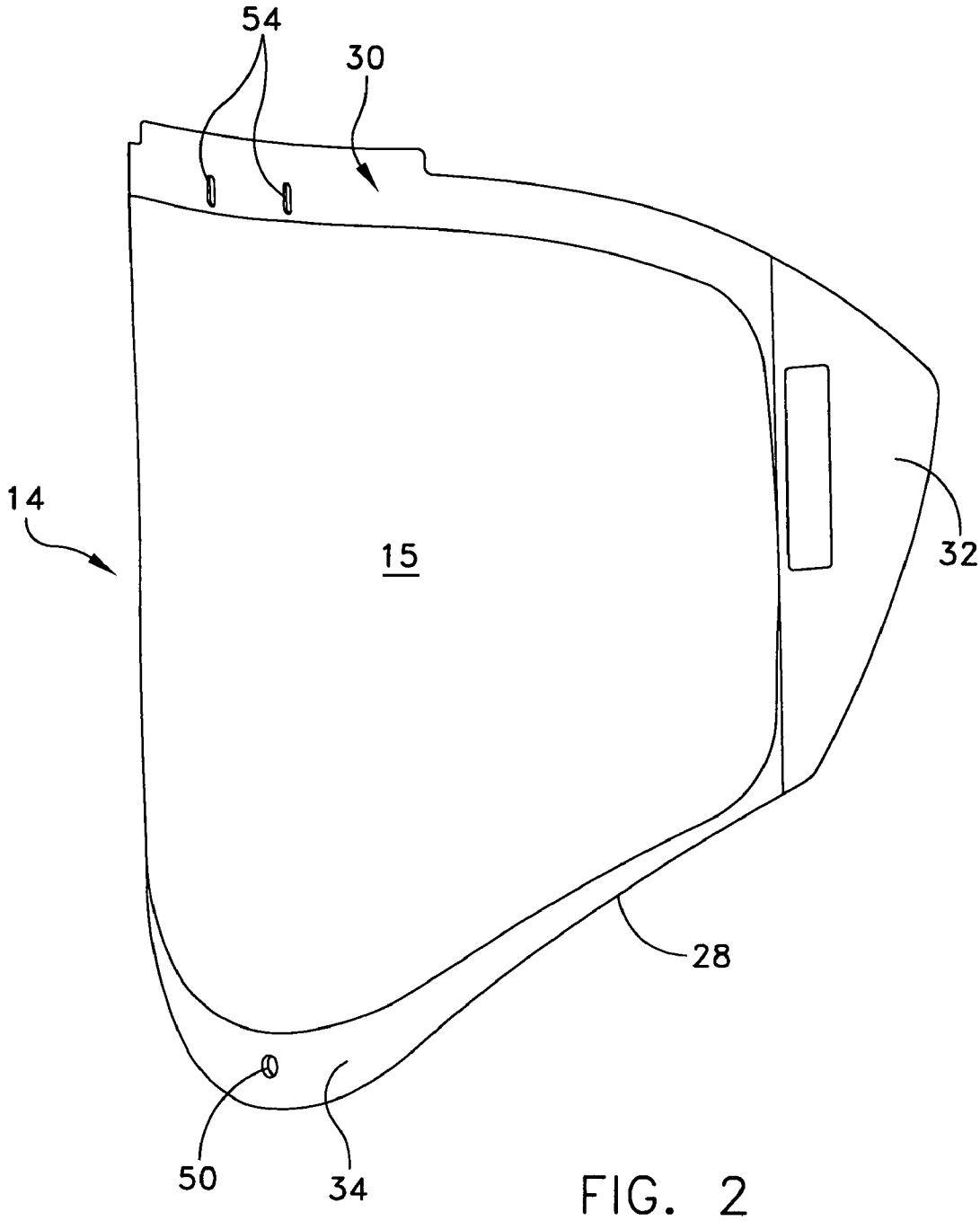
FIG. 2 is a front perspective view of the protective element or lens alone.
Figure 3:
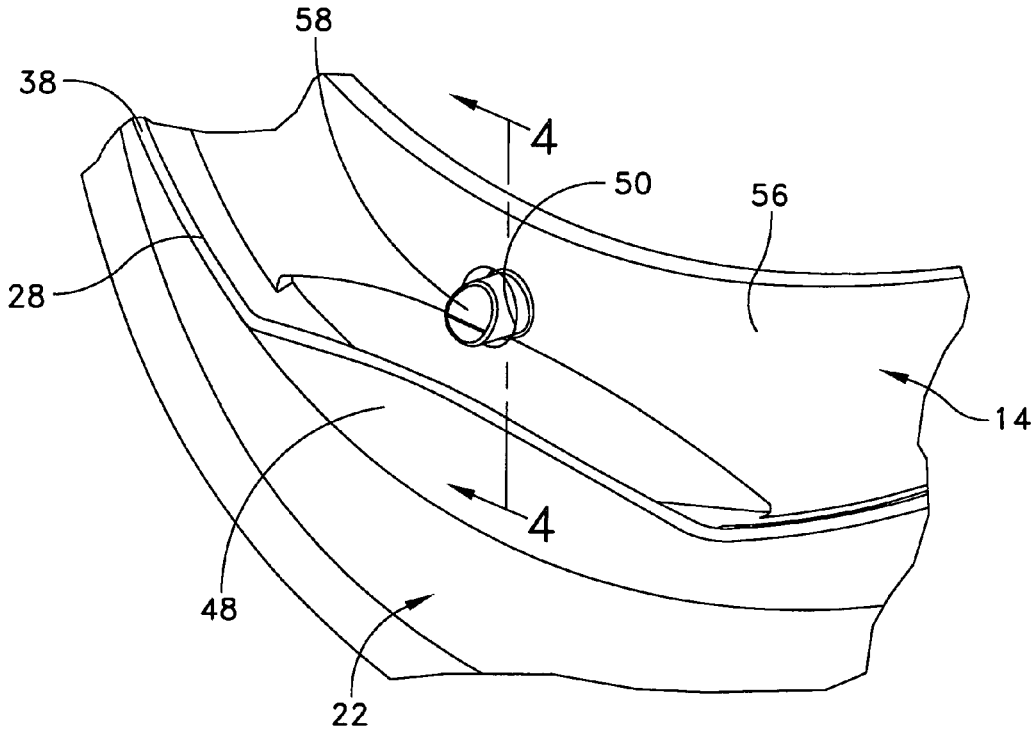
FIG. 3 is a fragmentary view illustrating the manner in which the bottom end of the protective element is secured in the support frame.

Referring now to FIG. 2, one embodiment of a protective element 14 is illustrated. In this embodiment the protective element is a lens 15. The lens 15 is preferably injection molded into a sheet made of, for example, polycarbonate, acrylic, polyester, or any other of a variety of materials that are well known in the art. The lens 15 may be substantially planar in its uninstalled position. Alternately, the lens may be pre-molded into a spherical or other rounded shape. The lens 15 may also be coated with a variety of chemical coatings, depending upon the particular application. For example, the lens may include an anti-fog coating, a reflective coating, may have a coating applied to improve the chemical and/or scratch resistance of the lens, or any other coating as is well known in the art. The lens is preferably shaped and sized to fit into the shape and size opening provided in the frame. In the present embodiment, the lens includes a slightly arcuate upper edge 30, side edges 32 which curve slightly backward and a lower edge 34. Alternatively, a variety of shaped lenses (or protective elements) may be utilized, depending upon the shape of the corresponding opening, as described above. The lens is sufficiently flexible so that it curves or bends without fracturing it when placed within the opening of the face shield frame 12. The protective element illustrated in FIG. 2 is preferably used, as shown, in its pre-formed configuration.

Protective element 14 is removably secured within the frame by a groove or channel 38 that is preferably formed between the inner edges 25 of the top, bottom and side portions and a lip 40. As best shown in FIG. 1, the channel 38 is formed between the inner edges 25 of the frame 12 and the lip 40, and is sized to receive the edges of the protective element 14. In order to more securely fit the protective element into the channel, a plurality of fingers or ridges 42 supported on an inner surface of the lip 40 are preferably provided. The ridges 42 also aid in the manufacturing process of the shell by making the lip more rigid. Any suitable number of ridges may be provided, as desired. The lip 40 and ridges 42 may also be formed as a single, unitary piece with the remaining portion of the frame. Alternately, the pieces may be formed as separate members and joined in any manner, as known to those of skill in the art.

In addition to channel 38, an upper detent 46 and a lower detent 48 are also preferably provided, as shown, for example, in FIG. 1. The upper and lower detents may be approximately centered on the top inner edge and bottom inner edge respectively, of the frame. During use, the detents aid in placement and securing of the protective element 14 within the opening 16. Both the upper detent 46 and the lower detent 48 may include one or more backing ridges to help secure the lens. Once the protective element 14 is secured within the channel 38 such that it covers the opening 16, a continuous outer surface is formed to protect the user's eyes and face from external hazards when the user wears the face shield assembly.

As will be appreciated, because no fasteners are required to secure the protective element to the frame, the user may readily replace the protective element even with gloved hands. For example, if the lens is damaged it may be replaced, or if the user is changing applications a lens having different characteristics may be replaced for the existing lens. As will also be appreciated, because of the lack of fasteners, the inserting and removing the lens is simple and intuitive, even during the user's first replacement or insertion. This is true, at least in part, because once the edges are inserted within the channel the lens is self locating. In other words, there is no need for a specific alignment in order to place holes in a proper position with corresponding fasteners. In addition, the use of the interlocking feature of the present invention further assures a positive securing or nesting of the lens, while still enabling ready removal thereof.

Reference is now made to FIG. 2 which is a perspective view of the protective element or lens shown separate from the support frame of the face shield. As indicated previously, the protective element has a peripheral edge region 28 that is adapted to engage with a groove or channel of the support frame so as to position the protective element. Mention has also been made hereinbefore regarding the upper and lower detents 46 and 48. At about the same location of these detents, in the protective element, as illustrated in FIG. 2, there is provided an upper retaining area indicated at 30 and a lower retaining area indicated at 34. These areas 30 and 34 may be masked off as illustrated in FIG. 2 or the entire surface may be transparent. FIG. 2 also illustrates a single hole at the bottom area 34 and a pair of through slots 54 at the top area 30. The hole 50 is preferably centered as illustrated in FIGS. 1 and 2. The through slots 54 are disposed symmetrically. In another version of the invention only a single through slot 54 may be employed at a center position, although at least a pair is preferred.

Figure 4:
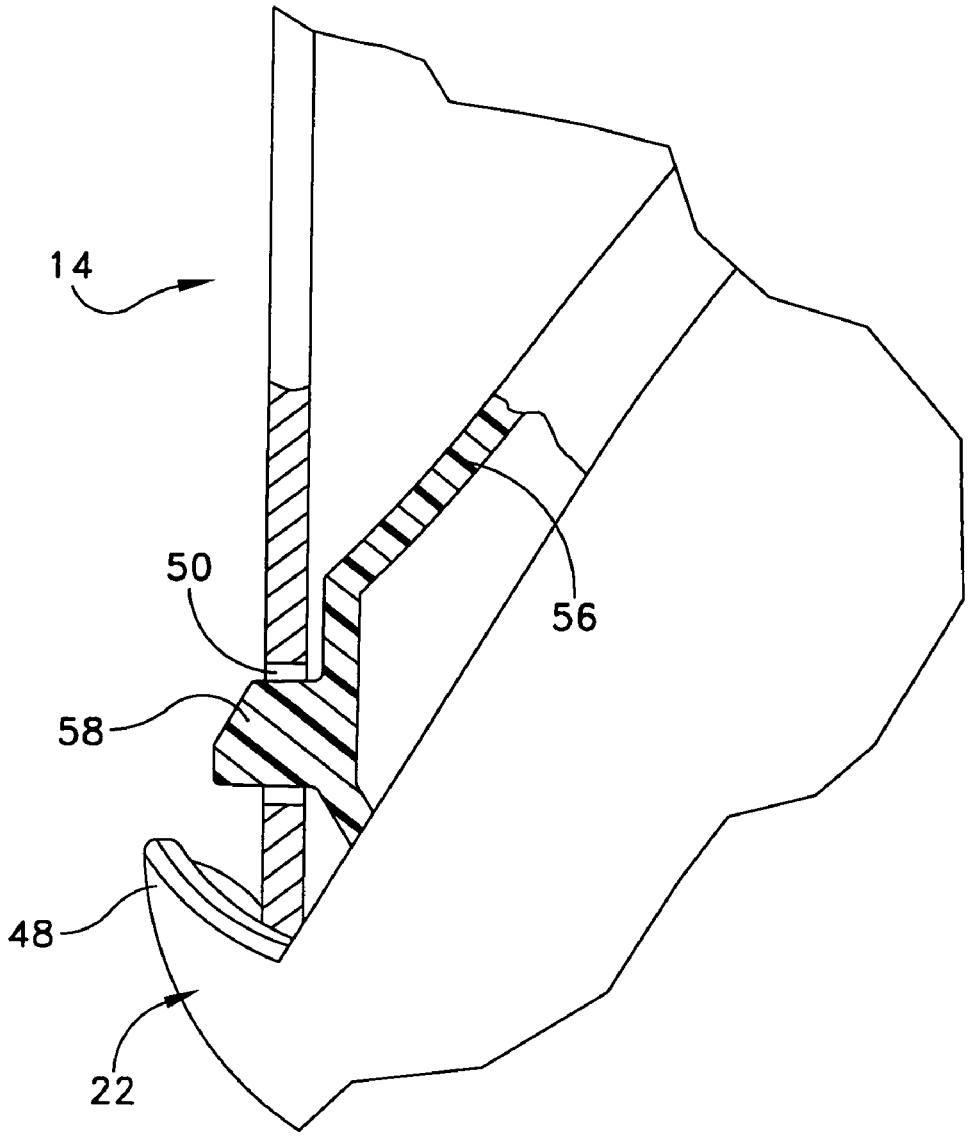
FIG. 4 is a cross-sectional view taken along line 4-4 of FIG. 3.
Figure 5:
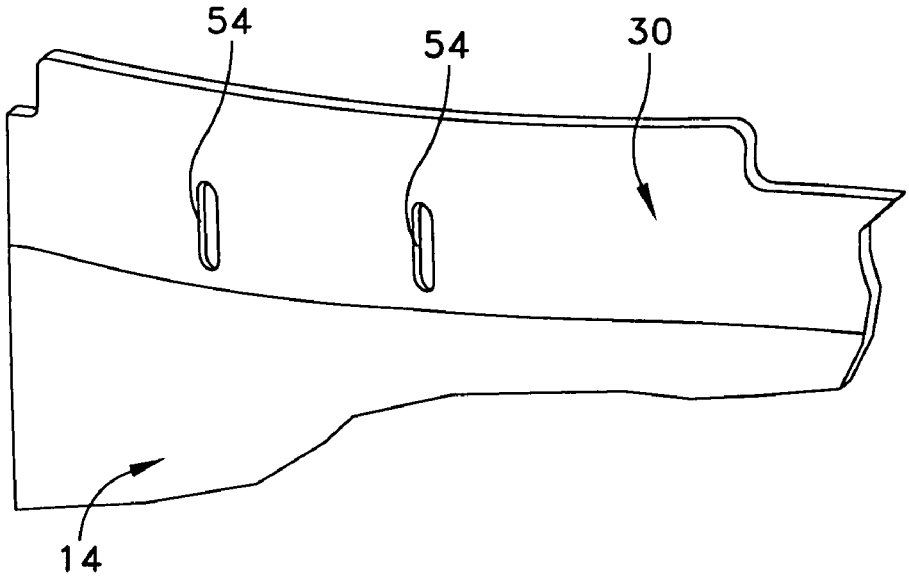
FIG. 5 is a fragmentary view illustrating the interlocking slots at the top of the protective element.
Figure 6:
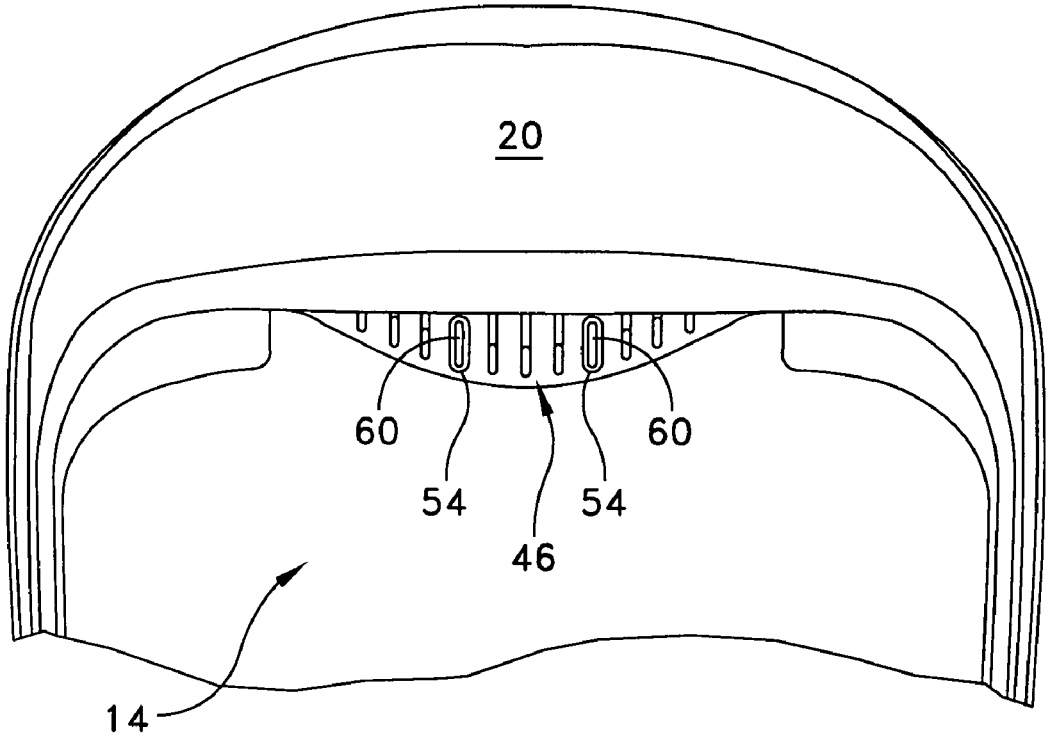
FIG. 6 is a fragmentary rear view showing the manner in which the top end of the protective element interlocks with the support frame.

The bottom portion 22 of the support frame also includes a bridge member 56 that supports the post 58. The bridge member 56 is supported behind the lower detent 48. When the protective element 14 is engaged with its support frame, the post 58 is adapted to pass through the hole 50 thus interlocking the protective element with the support frame at the bottom section thereof. Refer also to the cross-sectional view of FIG. 4 which illustrates the post 58 extending forwardly through the hole 50 at the bottom of the protective element 14. FIG. 4 also illustrates the lower detent 48 that is also used to capture the bottom edge of the protective element. Thus, one interlock is preferably used at the bottom of the shield that, not only is retained by the detent 38, but is also interlocked to more positively retain the protective element within the frame. There is preferably sufficient space between the post 58 and the detent 48 so that the user can relatively easily deflect the lens so as to disengage the lens from the frame.

Reference is now made to FIGS. 5-8 for a further illustration of the interlock member at the top part of the protective element. As indicated previously, the protective element itself is provided with a pair of through slots 54. These are adapted to engage with respective ribs 60. In the disclosed embodiment, the ribs 60 comprise two of a series of parallel arranged ribs that are disposed on the inside surface of the upper detent 46. The ribs that do not extend form a backing support for the lens. Thus, a further interlock is preferably used at the top of the shield that, not only is retained by the detent 46, but is also interlocked to more positively retain the lens within the frame. There is preferably sufficient space between the projections 60 and the detent 46 so that the user can relatively easily deflect the lens so as to disengage the lens from the frame.

Figure 7:
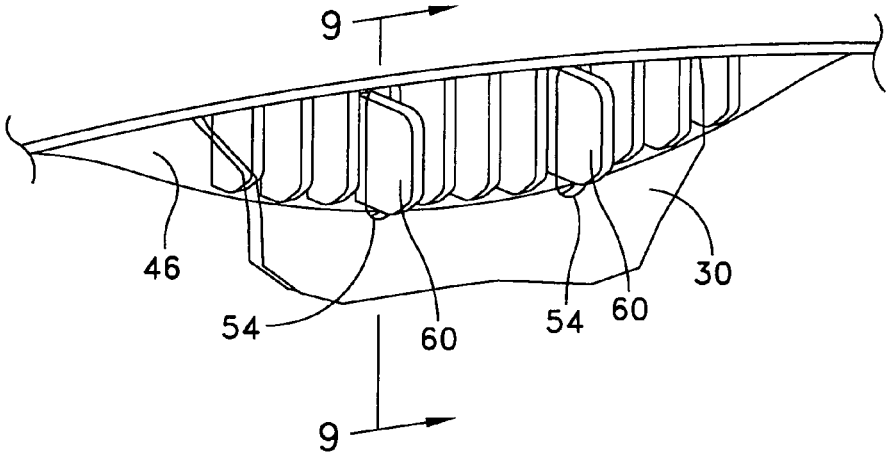
FIG. 7 is an enlarged fragmentary view illustrating the interlocking at the top of the protective element.
Figure 8:
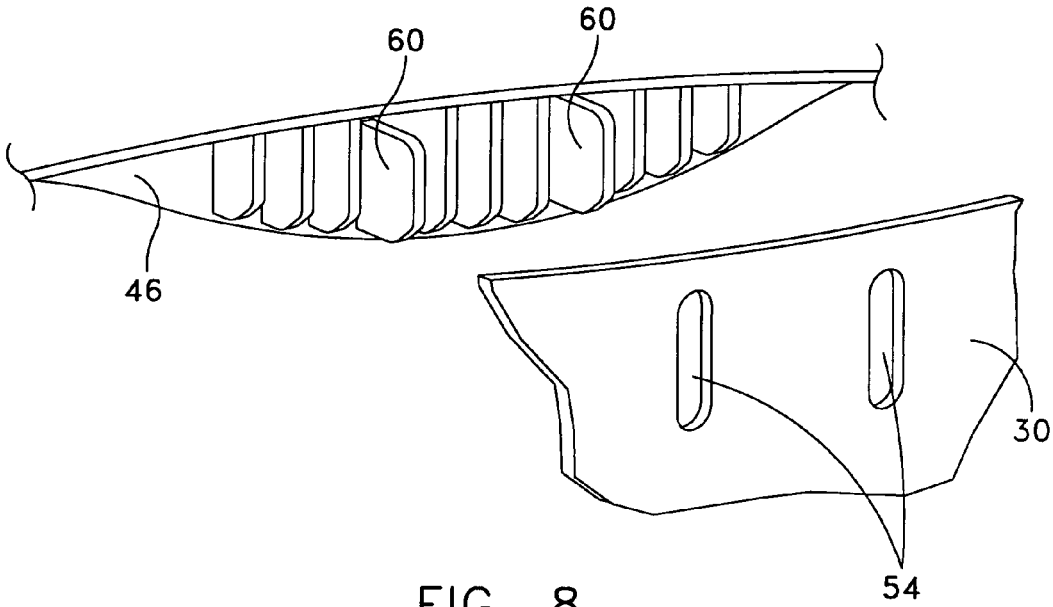
FIG. 8 is a perspective fragmentary view showing the components of FIG. 7 exploded from each other.
Figure 9:
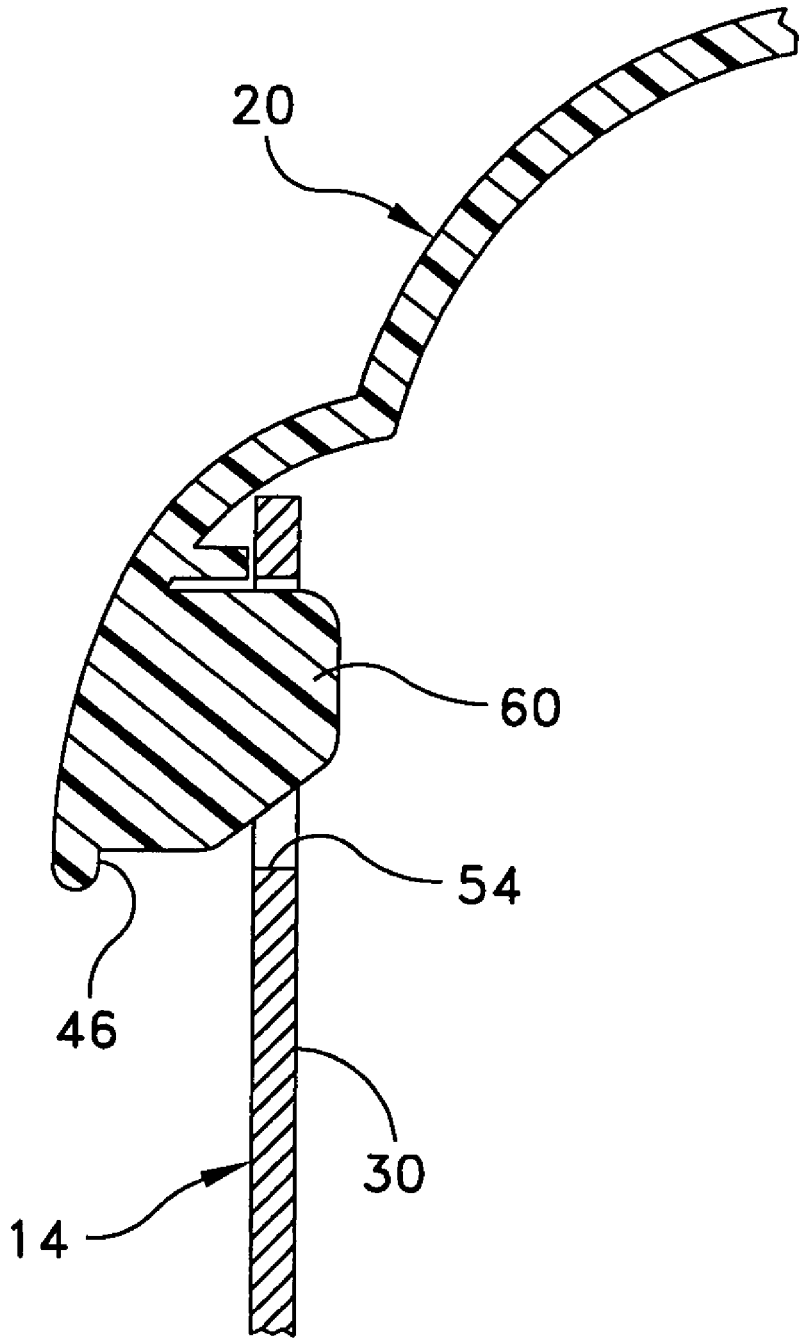
FIG. 9 is a cross-sectional view taken along line 9-9 of FIG. 7.

FIGS. 7-9 illustrate the two ribs 60 extending beyond the other shallower ribs. In FIG. 7, when the protective element is in place it is noted that the longer ribs 60 extend through the holes 54 while the other ribs remain as a backing surface for the protective element. FIG. 8 illustrates the portion of the interlocking member at the support frame including the ribs 60 with the fragmentary portion of the protective element exploded away from the ribs 60.

In the preferred embodiment disclosed herein, it is noted that a single interlocking arrangement is shown at the bottom of the protective element while a pair of interlocking members are used at the top. In another embodiment only a single slot 54 may be employed associated with a single extending rib 60. In that case the slot and rib are preferably centrally disposed. Moreover, although slots are shown at the top and a hole at the bottom, in alternate embodiments the slots and holes may be interchanged.

It will be understood that various modifications may be made to the embodiments disclosed herein. For example, it should be understood that a variety of materials may be utilized for both the frame and the protective element, that the frame and lens may have alternate shapes other than those shown, depending upon the particular application, and that the frame need not be made as a unitary member. Therefore, the above description should not be construed as limiting, but merely as exemplifications of preferred embodiments. Those skilled in the art will envision other modifications within the scope, spirit and intent of the invention.

What is claimed is:

1. For a face shield assembly, a protective element in combination with a support frame for holding the protective element, said support frame having a top portion, a bottom portion and opposite side portions, said protective element having a peripheral edge region that is adapted to engage about an opening in said support frame, substantially opposed retaining areas of said peripheral edge region having interlocking members including, respectively, a protective element interlock member and a support frame interlock member, said interlock members adapted for releasable interlocking engagement to hold the protective element in place in said support frame, said opening defined by an inner edge of the support frame that extends in an outward direction continuously about the support frame bottom portion and side portions, a lip that also extends in an outward direction from the support frame, said lip disposed inwardly of and substantially in parallel to the inner edge, said lip furthermore extending continuously about the opening, inboard of the inner edge, and extending along a length that is substantially coterminous with the inner edge, said inner edge and lip forming therebetween a continuous channel that is constructed and arranged to receive a major length portion of the peripheral edge region of the protective element wherein the protective element interlock member includes at least one of a hole and slot and the support frame interlock member includes at least one of a pin, post and projection.

2. The face shield assembly of claim 1 said protective element comprises a lens, and said lens interlock member including a top lens interlock member and said support frame interlock member including a top support frame interlock member, said top lens interlock member including at least two slots disposed at the top of the lens, extending in parallel and extending in a direction between the top and bottom interlock means.

3. The face shield assembly of claim 2 wherein said top support frame interlock member includes greater than two ribs disposed at the top of the support frame, extending in parallel, extending in a lengthwise direction between the top and bottom interlock means and extending widthwise in a forward direction behind the upper inner edge of the support frame, and said ribs, when the lens is positioned in the support frame, engaging corresponding slots in the lens to provide an interlock between the lens and support frame.

4. The face shield assembly of claim 3 wherein the spacing between the slots is greater than the spacing between adjacent ribs.

5. The face shield assembly of claim 4 wherein the greater than two ribs include two longer ribs measured widthwise and greater than two shorter ribs measured widthwise.

6. The face shield assembly of claim 5 wherein it is the two longer ribs that engage with the at least two slots in the lens.

7. The face shield assembly of claim 1 wherein the hole in the protective element is provided at the bottom of the protective element and the post is provided at the bottom of the support frame with the post extending through the hole to provide the interlocking.

8. The face shield assembly of claim 7 wherein the slot in the protective element is provided at the top of the protective element and the projection is provided at the top of the support frame with the projection extending through the slot to provide the interlocking.

9. The face shield assembly of claim 1 wherein the slot in the protective element is provided at the top of the protective element and the projection is provided at the top of the support frame with the projection extending through the slot to provide the interlocking.

10. The face shield assembly of claim 9 including at least a pair of spaced slots and a corresponding pair of spaced projections.

11. The face shield assembly of claim 1 wherein the opposed retaining areas include an upper detent on the frame and a lower detent on the frame.

12. The face shield assembly of claim 11 wherein the lower detent is disposed more forward of the support frame interlock member, and the support frame interlock member comprises a post that engages with a hole in the protective element.

13. The face shield assembly of claim 11 wherein the frame includes a top portion, a bottom portion and a side portion, and the opening is sized to fit the protective element, the opening defined by an upper inner edge, a lower inner edge, and side inner edges of the frame.

14. The face shield assembly of claim 13 wherein the upper detent is formed by a discontinuity in the upper inner edge forming a crescent shaped area at the top portion of the frame that is directed toward the lower detent, and the lower detent is formed by a discontinuity in the lower inner edge forming a crescent shaped area at the bottom portion of the frame that is directed toward the upper detent.

15. A face shield assembly comprising:

a protective element including an edge;

a-frame including a top portion, a bottom portion and a side portion, the frame further including:

a) an opening sized to fit the protective element, the opening defined by an upper inner edge, a lower inner edge, and side inner edges of the frame;

b) a lip spaced from the upper, lower and side inner edges so as to form a channel constructed and arranged to receive a major length portion of the edge of the protective element;

said lip furthermore extending continuously about the opening, inboard of the inner edge, and extending along a length that is substantially coterminous with the inner edge, an upper detent supported from the frame;

a lower detent supported from the frame;

an upper interlock disposed behind the upper detent and including at least one through passage in the protective element adjacent a top edge thereof, and at least one forwardly directed projection that engages with the passage; and a lower interlock disposed behind the lower detent and including at least one through passage in the protective element adjacent a bottom edge thereof, and at least one forwardly directed pin that engages with the passage;

said upper detent formed by a discontinuity in the upper inner edge forming a convex crescent shaped area at the top portion of the frame that is directed toward the lower detent;

said lower detent formed by a discontinuity in the lower inner edge forming a convex crescent shaped area at the bottom portion of the frame that is directed toward the upper detent.

16. The face shield assembly of claim 15 including a linear array of projections as part of the upper interlock with less than all of the projections engaging the protective element.

17. The face shield assembly of claim 16 wherein the projections that do not engage through the protective element form a backing for the protective element.

18. The face shield assembly of claim 17 wherein the protective element has a pair of slots at the top and only a single hole at the bottom thereof.

19. The face shield assembly of claim 15 wherein said upper passage is a slot and said lower passage is a round hole.

20. The face shield assembly of claim 19 wherein the upper pin is at least two projections of substantially rectangular cross-section, and said lower pin is a post of substantially circular cross-section.

21. The face shield assembly of claim 15 wherein said opening is defined by the upper, lower and side inner edges of the support frame that extends in an outward direction continuously about at least the support frame bottom portion and side portions, a lip that also extends in an outward direction from the support frame, said lip disposed inwardly of and substantially in parallel to the inner edges, said inner edges and lip forming therebetween a channel that is constructed and arranged to receive a portion of the peripheral edge region of the lens.

22. For a face shield assembly that includes a lens in combination with a support frame for holding the lens, said lens having a peripheral edge region that is adapted to engage about an opening in the support frame, the improvement comprising:

substantially opposed interlocking means located at the peripheral edge region of the lens having interlocking members including, respectively, a lens interlock member and a support frame interlock member, said interlock members adapted for releasable interlocking engagement to hold the protective element in place in said support frame;

said support frame defining an upper inner edge, a lower inner edge, and side inner edges of the support frame;

said lens having a top peripheral edge, a bottom peripheral edge and opposed side peripheral edges, said substantially opposed interlocking means including a top interlocking means and a bottom interlocking means;

said lens interlock member including a top lens interlock member and said support frame interlock member including a top support frame interlock member;

said top lens interlock member including at least two elongated holes extending through the lens and disposed adjacent to the top peripheral edge of the lens, extending in parallel to each other, spaced from the top peripheral edge of the lens and extending longitudinally in a direction transverse to the top peripheral edge of the lens;

said top support frame interlock member including greater than two elongated ribs disposed at the top of the support frame, extending in parallel to each other, extending in a lengthwise direction transverse to the support frame upper inner edge and extending widthwise in a forward direction behind and away from the upper inner edge of the support frame;

said elongated ribs, when the lens is positioned in the support frame, engaging the corresponding elongated holes in the lens to provide an interlock between the lens and support frame.

23. The face shield assembly of claim 22 wherein the lens interlock member includes a bottom lens interlock member having at least one of a hole and slot in the lens and the support frame interlock member includes a bottom support frame interlock member having at least one of a pin, post and projection on the support frame.

24. The face shield assembly of claim 23 wherein the hole in the lens is provided at the bottom of the lens and the post is provided at the bottom of the support frame with the post extending through the hole to provide the interlocking.

25. The face shield assembly of claim 22 further including an upper detent supported from the frame, a lower detent supported from the frame, said upper detent formed by a discontinuity in the upper inner edge forming a crescent shaped area at a top portion of the frame that is directed toward the lower detent and said lower detent formed by a discontinuity in the lower inner edge forming a crescent shaped area at a bottom portion of the frame that is directed toward the upper detent.

26. The face shield assembly of claim 22 wherein said opening is defined by the upper, lower and side inner edges of the support frame that extends in an outward direction continuously about at least the support frame bottom portion and side portions, a lip that also extends in an outward direction from the support frame, said lip disposed inwardly of and substantially in parallel to the inner edges, said inner edges and lip forming therebetween a channel that is constructed and arranged to receive a portion of the peripheral edge region of the lens.

27. For a face shield assembly that includes a lens in combination with a support frame for holding the lens, said lens having a peripheral edge region that is adapted to engage about an opening in the support frame, the improvement comprising:

substantially opposed interlocking means located at the peripheral edge region of the lens having interlocking members including, respectively, a lens interlock member and a support frame interlock member, said interlock members adapted for releasable interlocking engagement to hold the protective element in place in said support frame;

said support frame defining an upper inner edge, a lower inner edge, and side inner edges of the support frame;

said substantially opposed interlocking means including a top interlocking means and a bottom interlocking means;

said lens interlock member including a top lens interlock member and said support frame interlock member including a top support frame interlock member;

said top lens interlock member including at least two elongated holes disposed at the top of the lens, extending in parallel to each other, spaced from the peripheral engagement edge of the lens and extending in a direction between the top and bottom interlock means;

said top support frame interlock member including greater than two elongated ribs disposed at the top of the support frame, extending in parallel to each other, extending in a lengthwise direction between the top and bottom interlock means and extending widthwise in a forward direction behind the upper inner edge of the support frame;

said elongated ribs, when the lens is positioned in the support frame, engaging the corresponding elongated holes in the lens to provide an interlock between the lens and support frame;

wherein the spacing between the elongated holes are greater than the spacing between adjacent ribs.

28. The face shield assembly of claim 27 wherein the greater than two ribs include two longer ribs measured widthwise and greater than two shorter ribs measured widthwise.

29. The face shield assembly of claim 28 wherein it is the two longer ribs that engage with the at least two elongated holes in the lens.

30. The face shield assembly of claim 28 wherein at least two shorter ribs are disposed between the longer ribs.

31. For a face shield assembly that includes a lens in combination with a support frame for holding the lens, said lens having a peripheral edge region that is adapted to engage about an opening in the support frame, the improvement comprising:

substantially opposed interlocking means located at the peripheral edge region of the lens having interlocking members including, respectively, a lens interlock member and a support frame interlock member, said interlock members adapted for releasable interlocking engagement to hold the protective element in place in said support frame;

said support frame defining an upper inner edge, a lower inner edge, and side inner edges of the support frame;

said substantially opposed interlocking, means including a top interlocking means and a bottom interlocking means;

said lens interlock member including a top lens interlock member and said support frame interlock member including a top support frame interlock member;

said top lens interlock member including at least two elongated holes disposed at the toy of the extending parallel to each other, spaced the peripheral engagement edge of the lens and extending in a direction between the top and bottom interlock means;

said top support frame interlock member including greater than two elongated ribs disposed at the top of the support frame, extending in parallel to each other, extending in a lengthwise direction between the top and bottom interlock means and extending widthwise in a forward direction behind the upper inner edge of the support frame;

said elongated ribs, when the lens is positioned in the support frame, engaging the corresponding elongated holes in the lens to provide an interlock between the lens and support frame;

wherein the ribs include two longer ribs measured widthwise and greater than two shorter ribs measured widthwise, the longer ribs for engagement with corresponding elongated holes in the lens and the shorter ribs form*ing a backing surface for receiving a back surface of the lens.

32. The face shield assembly of claim 31 wherein shorter ribs are disposed on both sides of the longer ribs.

* * * * *